US005216438A

United States Patent [19]

Nakao et al.

[11] Patent Number: 5,216,438

[45] Date of Patent: Jun. 1, 1993

[54] DIRECT COLOR THERMAL PRINTING METHOD FOR OPTICALLY AND THERMALLY RECORDING A FULL-COLOR IMAGE ON A THERMOSENSITIVE RECORDING MEDIUM

[75] Inventors: Souichiro Nakao; Nobuo Katsuma; Atsushi Nagata, all of Tokyo, Japan

[73] Assignee: Fuji Photo Film Co., Ltd., Kanagawa, Japan

[21] Appl. No.: 779,086

[22] Filed: Oct. 18, 1991

[30] Foreign Application Priority Data

Oct. 20, 1990 [JP] Japan ..... 2-282925

[51] Int. Cl.[5] ..... B41M 5/28

[52] U.S. Cl. ..... 346/76 PH; 346/108

[58] Field of Search ..... 400/120 MP; 346/76 PH, 346/76 L, 108, 135.1, 136, 134

[56] References Cited

U.S. PATENT DOCUMENTS 4,446,467 5/1984 Takiguchi et al. ..... 346/76 PH
4,734,704 3/1988 Mizutani et al. ..... 346/76 PH
4,833,488 5/1989 Mizutani et al. ..... 346/76 PH
4,962,386 10/1990 Hakkaku et al. ..... 346/76 PH

FOREIGN PATENT DOCUMENTS 0267056 10/1989 Japan .
0267057 10/1989 Japan .

*Primary Examiner*—Benjamin R. Fuller
*Assistant Examiner*—N. Le

[57] ABSTRACT

A direct color thermal recording method records full-color images on a thermosensitive color recording medium having at least three laminated thermosensitive recording layers which are developed in three colors. The optical recording is performed in at least the uppermost thermosensitive recording layer by being exposed to ultraviolet rays of a wavelength range specific to the individual recording layer to be recorded while controlling the intensity of rays according to desired color densities of pixels to be recorded in the corresponding layer. Thereafter, thermal recording is performed in a lower recording layer by applying heat energy to the color recording medium. The amount of heat energy is controlled so as to record pixels at the desired color densities in the lower recording layer, and also the heat energy is used to develop colors in at least an upper recording layer after having been subjected to optical recording.

20 Claims, 5 Drawing Sheets

DIRECT COLOR THERMAL PRINTING METHOD FOR OPTICALLY AND THERMALLY RECORDING A FULL-COLOR IMAGE ON A THERMOSENSITIVE RECORDING MEDIUM

BACKGROUND OF THE INVENTION

1. Field of Invention

The present invention relates to a direct color thermal printing method, and more particularly to a direct color thermal printing method wherein a full-color image is recorded on a thermosensitive recording medium by optical recording and thermal recording.

2. Related Art

There are globally two types of thermal printers: one type is for direct thermal recording using thermosensitive recording media and the other type is for thermal transfer recording including wax thermal transfer recording and thermal dye transfer recording. The direct thermal printers print images directly on thermosensitive recording media, so that no waste, such as a dye transfer sheet, is produced. Furthermore, the construction of the direct thermal printer is simpler and thus the running cost of the direct thermal printer is lower than that of the thermal transfer printer.

Because of these preferable features, the direct thermal printers tend to be used wider and wider. For example, most facsimile transmitters are provided with monochromatic direct thermal printers. Recently, a thermosensitive color recording medium, has been suggested, for example, in Japanese Laid-open Patent Application 61-213169, which has thermosensitive coloring layers for developing magenta, cyan and yellow colors which are laminated on one another, so that full-color images can be recorded thereon using direct thermal printers.

When recording a full-color image on this type of thermosensitive color recording medium, a thermal head thermally records a yellow frame of the image in a thermosensitive recording layer of the recording medium which is developed in a yellow color and, thereafter, the recording medium is exposed to light passing through a yellow filter so as to fix the thermosensitive recording layer which is developed in yellow. Next, a cyan frame of the image is thermally recorded in a thermosensitive recording layer which is developed in a cyan color and then fixed by being exposed to light passing through a cyan filter. Finally, a magenta frame of the image is thermally recorded in a thermosensitive recording layer, which is then fixed by being exposed to light passing though a magenta filter.

Because the above described conventional direct thermal color printing method needs six steps, that is three recording steps and three fixing steps, for each recording of a full-color image, this method is extremely time-consuming.

SUMMARY OF THE INVENTION

In view of the foregoing, a main object of the present invention is to provide a thermal color printing method by which a full-color image can be recorded in a few steps at a high speed.

To achieve the above and other objects, although conventional direct color thermal printing methods comprise the steps of controlling heat energy as to record thermally an image of desired tones and, thereafter, exposing the recorded image to sufficient light for fixing the recorded image optically, the present invention is directed to performing the thermal recording method in a reverse sequence. According to an embodiment of the present invention, recording in a first thermosensitive recording layer, which is developed in a first color and disposed on the top of the thermosensitive color recording medium and thus has the highest sensitivity, is optically performed using electromagnetic rays of a wavelength range that is specific to the thermosensitive recording layer, which is developed in the first color by controlling the intensity of the rays according to desired color density of each pixel. Thereafter, a second thermosensitive recording layer, which is developed in a second color and disposed in the second place from the top and has a lower or middle sensitivity, is applied with heat energy varied according to desired color density of each pixel so as to thermally record an image therein. Simultaneously, heat development of the first thermosensitive recording layer, which is developed in the first color, is performed using the heat energy for thermal recording of the second layer. Next, electromagnetic rays are projected onto the second thermosensitive recording layer, which is developed in the second color, so as to optically fix the second layer. Finally, heat energy is applied to a third thermosensitive recording layer, which is developed in a third color, disposed below the second thermosensitive recording layer and having the lowest sensitivity, according to desired color density of each pixel. The three thermosensitive recording comprise thermosensitive recording layers which are developed in layers yellow, magenta and cyan colors respectively. It is possible to provide more than three thermosensitive recording layers by adding further thermosensitive recording layers which are developed in other colors, for example, a thermosensitive recording layer which is developed in a black color.

According to the present invention, optical recording in a thermosensitive recording layer developed in color using electromagnetic rays of a specific range is performed such that only those elements developed in color, which are necessary for recording each pixel at a desired color density, are maintained in the thermosensitive recording layer. In other words, unnecessary color elements are optically fixed and thus lose their capacity to develop color. Therefore, when heat energy for thermal recording in the second thermosensitive recording layer is applied to the first thermosensitive recording layer, heat development of the first layer having the highest sensitivity is effected such that the remaining elements, which are not fixed, develop the color up to the maximum density. However, because the amount of elements is dependent on the light exposure amount, the first color developable thermosensitive recording layer contains an image whose density corresponds to the optical recording. The second thermosensitive recording layer is optically fixed after the thermal recording, and then thermal recording in the third thermosensitive recording layer is performed. In this way, because heat development in the first thermosensitive recording layer is performed using heat energy for thermal recording in the second thermosensitive recording layer, high speed printing is achieved and energy is also saved.

Although the heat energy necessary for color-developing in the third layer will not ordinarily be applied under normal reserving condition, it may be possible to perform an optical fixing process of the third layer.

According to another preferred embodiment of the present invention, recording in the first and second thermosensitive recording layers is performed respectively using electromagnetic rays of a wavelength range specific to the first thermosensitive color recording layer and the second layer, by controlling the intensity of rays according to the desired color density of each pixel. A heat energy variable according to the desired color density of each pixel is applied to the third thermosensitive recording layer so as to record an image thermally in the third layer and, at the same time, develop heat in the first and second thermosensitive color recording layers.

In this embodiment, because heat development in the first and second thermosensitive recording layers is performed using heat energy for thermal recording in the third thermosensitive recording layer, a full-color image can be obtained by only two steps of optical recording and a single step of thermal recording.

According to a further embodiment of the present invention, recording in the first and second thermosensitive recording layers is performed respectively using electromagnetic rays of wavelength ranges specific to the first layer and those specific to the second layer, by controlling the intensity of rays according to the desired color density of each pixel. Subsequently, heat development in the first and second layers is performed. Thereafter, heat energy variable according to the desired color density of each pixel is applied to the third thermosensitive recording layer so as to record an image thermally in the third layer.

In this embodiment, because the first and second thermosensitive recording layers are subjected to the heat development process after the optical recording in the first and second layers before the thermal recording in the third thermosensitive recording layer, unevenness of color development will never occur which would otherwise be caused by a deviation of the recording position of the third layer from those of the first and second layers.

BRIEF DESCRIPTION OF THE DRAWINGS

Other objects and advantages of the present invention will become apparent in the following detailed description of preferred embodiments when read in conjunction with accompanying drawings, wherein.

DETAILED DESCRIPTION OF THE PREFERRED EMBODIMENTS

Figure 1:
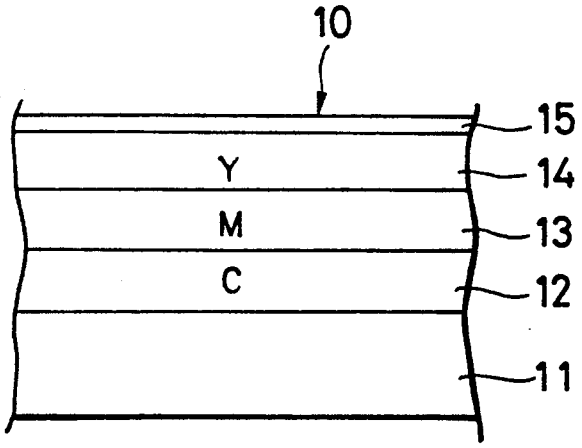
FIG. 1 is a partial section of a thermosensitive color recording medium, illustrating the laminated construction thereof.

FIG. 1 shows an example of thermosensitive color recording medium 10, hereinafter called simply a recording medium, used in the present embodiment, wherein a thermosensitive recording layer 12, which is developed in a cyan color and hereinafter called simply a cyan recording layer, a thermosensitive recording layer 13, which is developed in a magenta color and hereinafter called magenta recording layer, a thermosensitive recording layer 14, which is developed in a yellow color and hereinafter called simply a yellow recording layer, and a protective layer 15 are laminated on a supporting material 11 in this order from the bottom. Imaging in these thermosensitive recording layers 12 to 14 are sequentially performed from the top, that is from the yellow recording layer to the magenta recording layer 13 and then to the cyan recording layer 12.

The supporting material 11 is an opaque coated paper or plastic film. However, when it is intended to make an OHP (over-head projector) sheet, a transparent plastic film is used as the supporting material.

The cyan recording layer 12 contains an electron donating dye precursor and an electron accepting compound as main components, and develops cyan when a predetermined amount of heat energy per unit area is applied thereto. The magenta recording layer 13 contains a diazonium salt compound having a maximum absorption factor at a wave length of about 360 nm and a coupler which acts upon the diazonium salt compound and develops magenta when it is heated. The magenta recording layer 13 loses its capacity to develop color when it is exposed to ultraviolet rays of about 360 nm, because the diazonium salt compound is photochemically decomposed by this range of rays. The yellow recording layer 14 contains a second diazonium salt compound having a maximum absorption factor at a wave length of about 420 nm and a coupler which acts upon the second diazonium salt compound and develops yellow when it is heated. The yellow recording layer 14 also is optically fixed and thus loses its color developability when it is exposed to near ultraviolet rays of about 420 nm (blue-violet rays).

Figure 2:
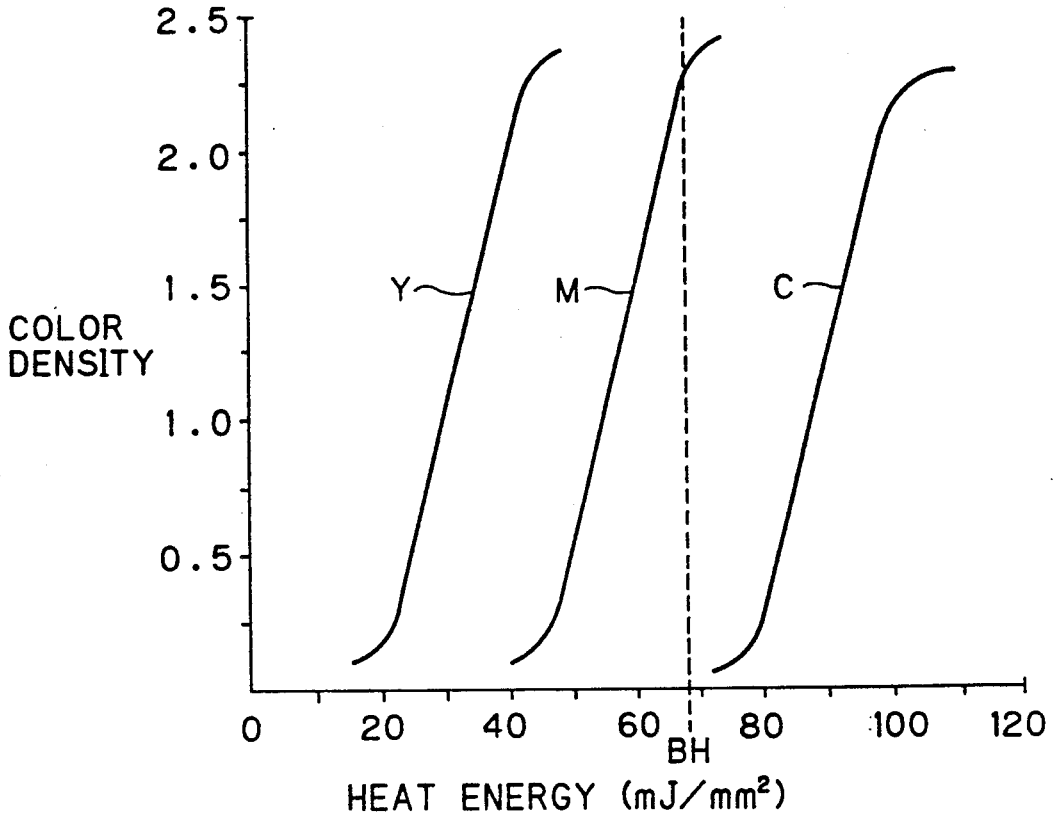
FIG. 2 is a graph showing color developing characteristics of the thermosensitive color recording medium.

FIG. 2 illustrates the respective characteristic curves of the thermosensitive coloring layers 12 to 14. The horizontal axis indicates the amount of heat energy per unit area applied to the recording medium of FIG. 1. The heat energy per unit area necessary for color-developing in the yellow recording layer 14 is the smallest, namely, the heat sensitivity of the yellow recording layer 14 is the highest. On the contrary, the heat energy for the cyan recording layer 12 is the largest, namely the heat sensitivity of the cyan recording layer is the lowest. This is mainly because heat energy reaches the cyan recording layer 12 after being transmitted through the yellow and magenta recording layers 14 and 13. Because such a large amount of heat energy per unit area as necessary for color-developing in the cyan recording layer 12 would not be applied to the recording medium 10 under an ordinary reserving condition, the cyan recording layer 12 is not provided with a capacity to be optically fixed. However, if necessary, it is possible to provide the cyan recording layer with such a capacity by adding a diazonium salt compound and a coupler. It is to be noted that the heat energy amount per unit time is dependent on the speed of recording medium transportation.

Figure 3:
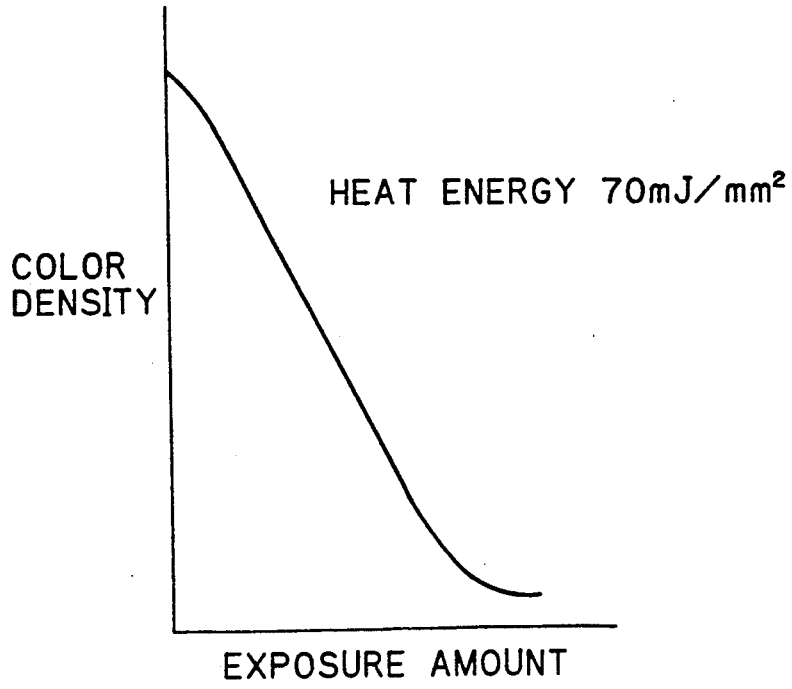
FIG. 3 is a graph showing a relationship between an exposure amount and a color density.

FIG. 3 shows a color density curve of the yellow recording layer 14 or the magenta recording layer 13 in case it is subjected to heat development after optical recording. For example, when the hellow recording layer 14 is exposed to near ultraviolet rays of about 420 nm, because the diazonium salt compound is decomposed, the coupler cannot act upon the diazonium salt compound even when heat energy is applied, so that its capacity to develop color is reduced. The degree of optical decomposition of the diazonium salt compound depends on the amount of exposed near ultraviolet rays. That is, a greater exposure amount will result in a smaller amount of remaining diazonium salt compound and thus the less color density, as shown in FIG. 3, even when sufficient heat energy is applied after exposure.

Figure 4:
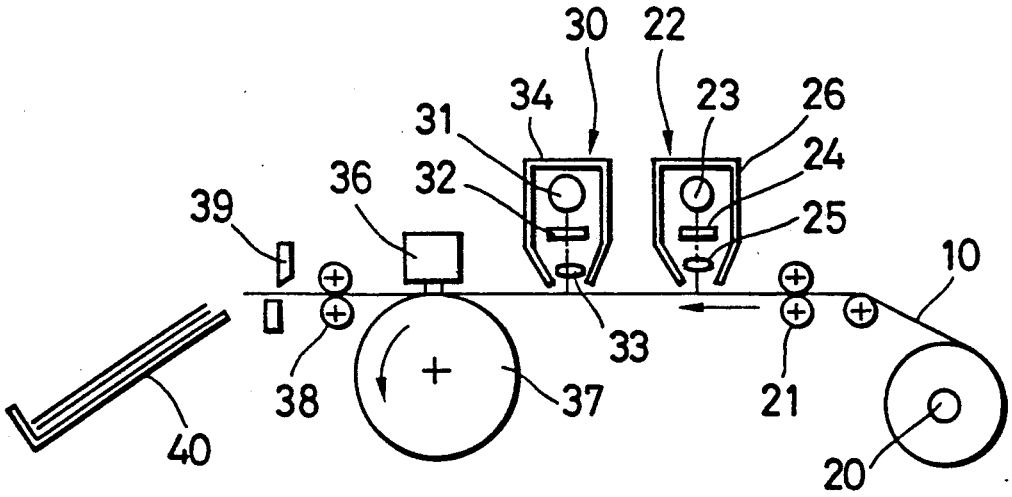
FIG. 4 schematically shows the overall construction of a direct color thermal printer embodying a first method of the present invention.

Referring to FIG. 4 showing an example of the direct color thermal printer embodying the present invention, a long strip of recording medium 10 is wound on a supply reel 20 to form a roll. The recording medium 10 is drawn out by a pair of rollers 21 toward a yellow image optical recording device 22. The yellow image optical recording device 22 exposes the yellow recording layer 14 to light beams, the amount of which is variable according to the respective density of pixels to be recorded. according to the respective density of pixels to be recorded. Thereby, a yellow image is recorded optically. The yellow image optical recording device 22 includes an ultraviolet lamp 23 radiating ultraviolet rays of about 420 nm wavelength, a light shutter device 24, a lens array 25 and a housing 26.

Figure 5:
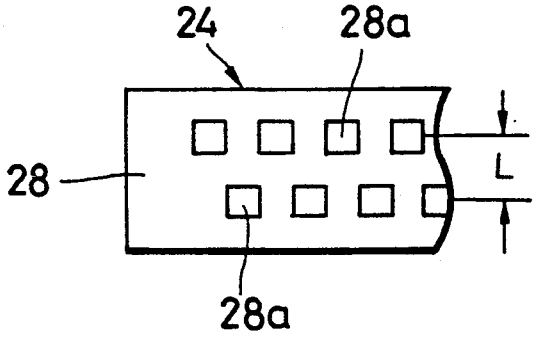
FIG. 5 is an explanatory view of a light shutter device for optical recording.

The light shutter device 24 includes a liquid crystal shutter device in which a large number of micro shutters 28*a* are formed on a liquid crystal panel 28, as shown in FIG. 5. The liquid crystal shutter device 24 includes individual electrodes and a common electrode, which is conventional, wherein the light transmittance thereof varies according to the voltage applied between the individual electrodes and the common electrode, and each area sectioned by the individual electrodes forms one micro shutter 28*a*. In this embodiment, the micro shutters 28*a* are arranged in two lines which are spaced by a distance L from each other in a secondary scanning direction, and each micro shutter of one line is staggered from those of the other line in a primary scanning direction such that a blank is not formed between the recorded pixels. The lens array 25 includes a plurality of small lenses which are arranged in two lines corresponding to the micro shutters 28*a*. The small lenses are formed integrally on a transparent plate.

A magenta image optical recording device 30 includes an ultraviolet lamp 31 radiating near ultraviolet rays of about 365 nm, a light shutter 32, a lens array 33 and a housing 34, in the same manner as for the yellow image optical recording device 22. The magenta image optical recording device 30 exposes the magenta recording layer 13 to light beams according to the respective densities of pixels to be recorded.

Figure 6:
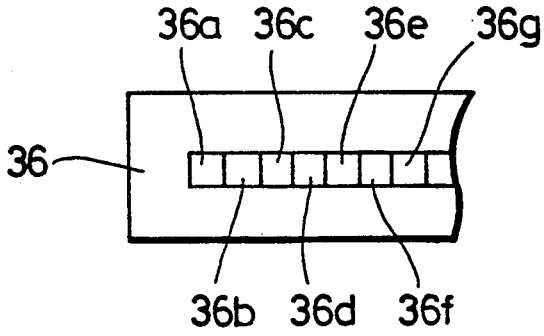
FIG. 6 is an explanatory view of a thermal head.

A thermal head 36 and a platen drum 37 are disposed downstream of the magenta image optical recording device 30. The thermal head 36 includes a large number of heat elements which are arranged in an array and each individually radiates an amount of heat energy dependent on a drive signal for corresponding pixel. FIG. 6 shows seven heat elements 36*a* to 36*g* thereof. The thermal head 36 is used to record a cyan image in the cyan recording layer 12 by applying appropriate heat energy thereto. Making use of this heat energy, the magenta and yellow recording layers 13 and 14 having optically recorded images are thermally developed, whereby the diazonium salt compounds remaining in these layers couple with the couplers and thus develop magenta and yellow colors. The recording medium 10 having a full-color image thereon is transported by a pair of feed rollers 38 and is cut by a cutter 39 into individual sheets which are ejected onto a tray 40.

Figure 7:
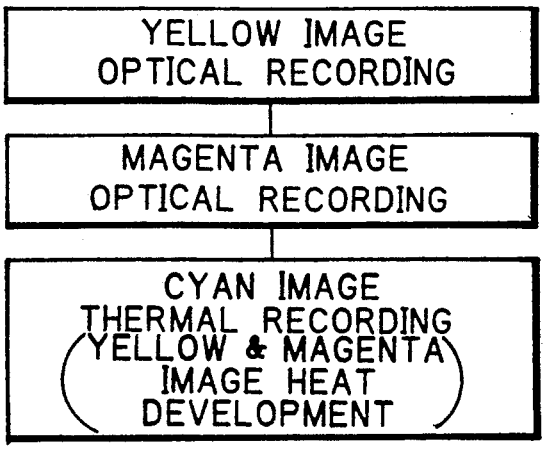
FIG. 7 is a flowchart explaining the first method of the present invention.

Next, the operation of the above described direct color thermal printer will be described with reference to FIG. 7. The recording medium 10 pulled out from the supply reel 20 is transported to the yellow image optical recording device 22, which is supplied with drive signals of the first line of yellow image pixels from a drive signal generator (which is not shown). The drive signals control the micro shutters 28*a* such as the transmittance thereof becomes less, the desired recording density of the corresponding pixel is higher.

In this way, the respective micro shutters 28*a*vary their transmittance according to the drive signals, so as to control the transmission quantity of the near ultraviolet rays of about 420 nm which are radiated from the ultraviolet lamp 23. At that time, the drive signals supplied to one line of the micro shutters 28*a* are electrically delayed from the drive signals supplied to the other line of the micro shutters 28*a* by a time interval in which the recording medium is transported by the distance L. Thereby, the recording positions of the pixels recorded by one line of the micro shutters 28*a* are aligned with the pixels recorded immediately before by the other line of the micro shutters 28*a*.

When the first line of the yellow image has been optically recorded in the yellow recording layer 14, the recording medium 10 is transported by a length corresponding to one line, and then the second line of yellow image is optically recorded. The third and following lines are recorded line by line in the same way as above until the whole yellow image is formed in the yellow recording layer 14.

When the part of recording medium in which the yellow image is recorded is moved in a position under the magenta image optical recording device 30, a magenta image is recorded line by line in the magenta recording layer 13 using the ultraviolet rays of about 365 nm. It is possible optically to record the magenta image before the yellow image.

When the part in which the magenta image is optically recorded reaches the recording position of the thermal head 36, the thermal head 36 thermally records a cyan image line by line in the cyan recording layer 12. For this thermal recording of this cyan image, the heat elements 36*a* etc. apply a heat energy variable according to the desired recording density of each pixel within a range from about 75 to 100 $mJ/mm^2$ onto the recording medium 10. Because this range of heat energy is higher than those necessary for heat development in the magenta and yellow recording layers 13 and 14, the diazonium salt compound remaining in these layers 13 and 14 thermally act upon the couplers therein. Therefore, the magenta and yellow colored images are developed simultaneously with the thermal recording of the cyan colored image, so that a full-color image appears on the recording medium 10. The recording medium 10 having the fullcolor image thereon is cut by the cutter 39 into sheets of a predetermined size and is ejected onto the tray 40.

According to the above embodiment, all pixels of the yellow and magenta images are developed so far as the respective recording positions of yellow and magenta pixels are completely coincident with those of the cyan pixels. However, if the recording position of the respective color images are not completely coincident with each other, not all of the yellow and magenta pixels are developed, so that the resulting full-color image would have missed portions, that is an, unevenness in color development occurs. Such an unevenness can be avoided by supplying at least a constant electric energy to every heat element of the thermal head 36 during thermal recording of the cyan image, so as to apply a predetermined amount of heat energy as a bias heat energy BH (see FIG. 2) to the whole area of the thermal recording medium 10, wherein the amount of the bias heat energy BH is slightly lower than the amount necessary for cyan color development in the cyan recording layer 12. Of the heat elements, those which must record cyan color pixels are driven to radiate individually an amount of heat energy higher than the bias heat energy and variable in accordance with the desired coor density.

Figure 8:
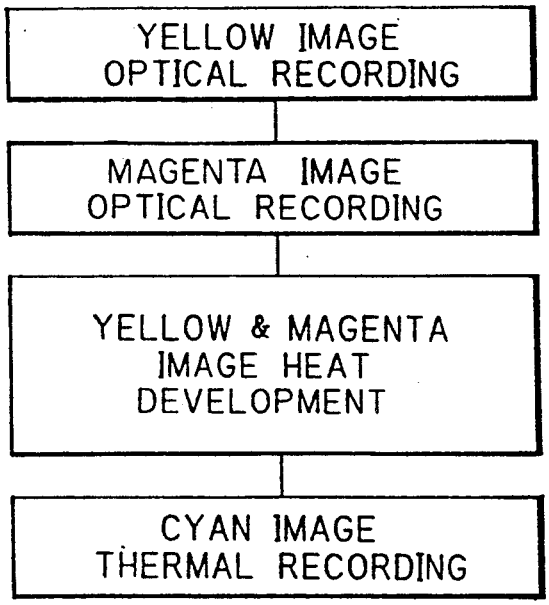
FIG. 8 is a flowchart explaining a second embodiment of the present invention.
Figure 9:
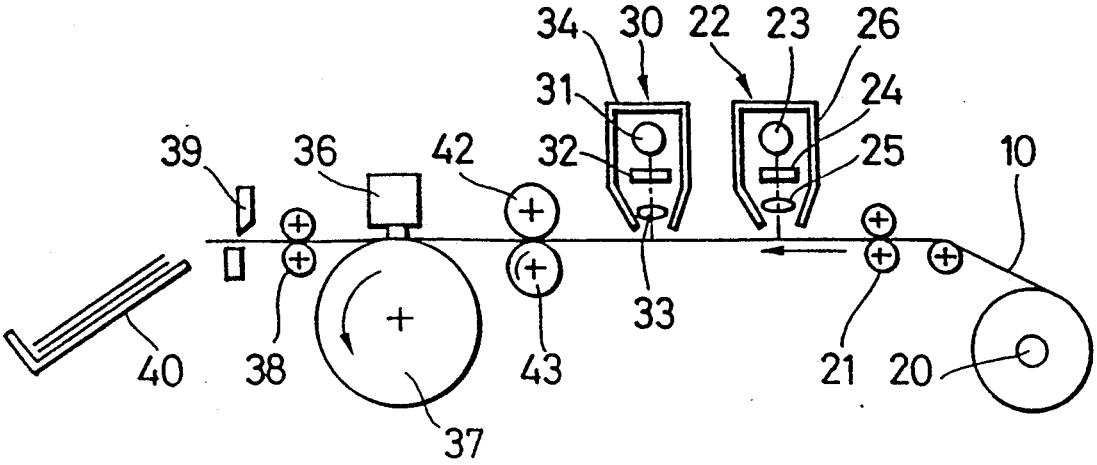
FIG. 9 shows a direct color thermal printer embodying the method of FIG. 8.

In case no bias heat energy is applied, it is preferable to perform heat development in the yellow and magenta recording layers 14 and 13 before thermal recording of the cyan image, as shown in FIG. 8. A direct color thermal printer shown in FIG. 9 embodies the method of FIG. 8, wherein a heat roller 42 having a built-in heater is disposed between a magenta image optical recording device 30 and thermal head 36. The heat roller 42 not only transports a recording medium 10 while nipping it between the roller 42 and a counter roller 43, but also applies heat energy for heat development in the yellow recording layer 14 and the magenta recording layer 13. The amount of heat energy applied by the heat roller may be equal to the bias heat energy BH. It may be possible for the counter roller 43 to be a heat roller. Other constructions of the printer of FIG. 9 are the same as the printer of FIG. 4.

Figure 10:
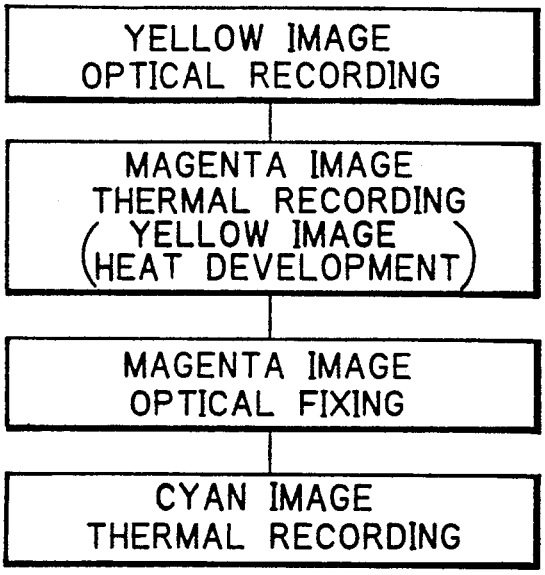
FIG. 10 is a flowchart explaining a third embodiment of the present invention.

It is also possible to make optical recording and heat development in only one of the three color recording layers. According to an embodiment of FIG. 10, the yellow recording layer 14 only subjected to thermal recording and heat development. A thermosensitive color recording medium 10, on which a yellow image is optically recorded by yellow image optical recording device 22, is subjected to thermal recording of a magenta image in the magenta recording layer 13 by a thermal head 45. Simultaneously with this thermal recording, heat development in the yellow recording layer 14 is effected, so that the yellow image appears with the magenta image.

Figure 11:
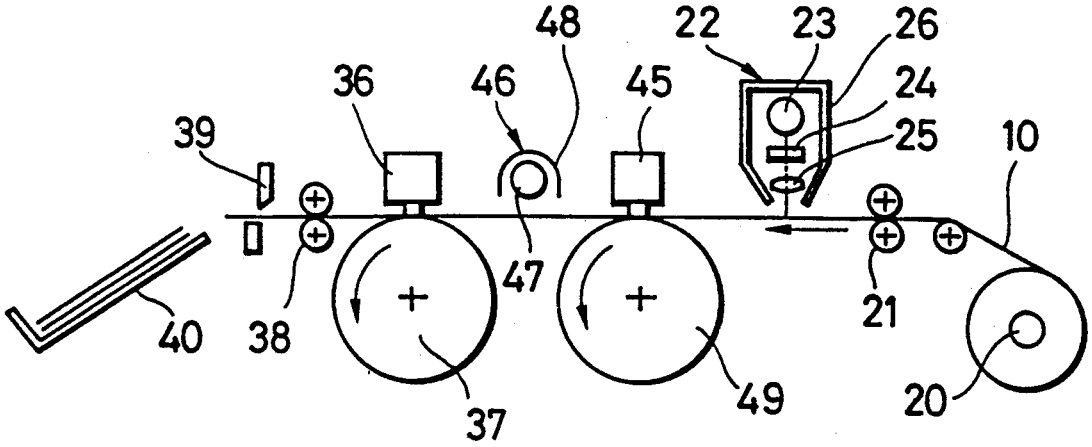
FIG. 11 shows a direct thermal color printer embodying the method of FIG. 10.

After the thermal recording of the magenta image, the recording medium 10 is passed by an optical fixing device for magenta color 46 which then optically fixes the magenta recording layer 13 as illustrated in FIG. 11. The magenta color optical fixing device 46 includes an ultraviolet lamp 47 radiating ultraviolet rays of about 365 nm and a reflector 48. After optically fixing of the magenta recording layer, a thermal head 36 thermally records a cyan image in the cyan recording layer 12. A platen drum 49 is provided for thermal recording of magenta image.

Although the above described embodiments use a recording medium having cyan, magenta and yellow recording layers laminated in this order from the bottom, it is possible to change the order of lamination. For example, the yellow recording layer may be the bottom layer, whereas the cyan recording layer may be the top layer. In this case, the cyan recording layer should be capable of being optically fixed, while the yellow recording layer may not have a capacity to be optically fixed. Recording in the cyan recording layer will be optically performed, and recording in the yellow recording layer will be thermally performed.

It is also possible to provide more than three thermosensitive recording layers, for example by adding a fourth thermosensitive recording layer which is developed in black. Furthermore, electromagnetic rays for optical fixing should not be limited to the above mentioned wavelength ranges, rather it is possible to select different and appropriate wavelength ranges for the respective coloring layers by changing the absorption of diazonium salt compound contained therein.

Furthermore, the present invention is applicable to serial printers wherein pixels are printed in serial by a two-dimensional movement of the recording medium relative to the thermal head and the optical recording device, although the present invention has only been described with respect to line printers wherein the recording medium is moved linearly relative to the thermal head and the optical recording device.

Thus, the present invention is not intended to be limited by the above described embodiments but, on the contrary, various modifications of the present invention can be effected without departing from the spirit and scope of the appended claims.

What is claimed is:

1. A direct color thermal printing method for recording a full-color image on a thermosensitive color recording medium having at least first, second and third thermosensitive recording layers laminated on a supporting material arranged in an order where the first thermosensitive recording layer is adjacent to a top of the thermosensitive color recording medium, the second thermosensitive recording layer is arranged below the first thermosensitive recording layer and the third thermosensitive recording layer is arranged below the second thermosensitive recording layer, each of the first, second and third thermosensitive recording layers independently having a capacity to develop a different color, at least the first and second thermosensitive recording layers being optically fixed when exposed to electromagnetic rays of individually specific wavelength ranges, and the third thermosensitive recording layer, which is arranged below the first and second thermosensitive recording layers, has a heat sensitivity lower than heat sensitivities of the first and second thermosensitive recording layers, said method comprising the steps of:

optical recording in the first thermosensitive recording layer using electromagnetic rays of a first predetermined wavelength range for the first thermosensitive recording layer by controlling an intensity of said electromagnetic rays according to color densities of pixels to be recorded in the first thermosensitive recording layer;

thermal recording in the second thermosensitive recording layer using heat energy by controlling a first amount of said heat energy according to color densities of pixels to be recorded, said heat energy being used for heat development in the first thermosensitive recording layer;

optical fixing of the second thermosensitive recording layer by exposing said thermosensitive color recording medium to electromagnetic rays of a second predetermined wavelength range for the second thermosensitive recording layer; and thermal recording in the third thermosensitive recording layer using a second amount of heat energy which is controlled accordingly to color densities of pixels to be recorded in the third thermosensitive recording layer.

2. A direct color thermal printing method as claimed in claim 1, wherein said first, second and third thermosensitive recording layers comprise thermosensitive recording layers which are developed in yellow, magenta and cyan colors, respectively.

3. A direct color thermal printing method as claimed in claim 2, wherein said electromagnetic rays of said first predetermined wavelength range for the first thermosensitive recording layer, which is developed in yellow, is near ultraviolet rays having a center wavelength of 420 nm, and said electromagnetic rays of said second predetermined wavelength range for the second thermosensitive recording layer, which is developed in magenta, is ultraviolet rays having a center wavelength of 365 mm.

4. A direct color thermal printing method as claimed in claim 3, wherein said near ultraviolet rays are radiated from an ultraviolet lamp through a liquid crystal shutter array having a plurality of micro shutters and a lens array having small lenses arranged corresponding to said micro shutters.

5. A direct color thermal printing method for recording a full-color image on a thermosensitive color recording medium having at least first, second and third thermosensitive recording layers laminated on a supporting material arranged in an order where the first thermosensitive recording layer is adjacent to a top of the thermosensitive color record medium, the second thermosensitive recording layer is arranged below the firsr thermosensitive recording layer and the third thermosensitive recording layer is arranged below the second thermosensitive recording layer, each of the first, second and third thermosensitive recording layers independently having a capacity to develop a different color, at least the first and second thermosensitive recording layers having a capacity of being optically fixed by electromagnetic rays of individually specific wavelength ranges, and the third thermosensitive recording layer, which is arranged below the first and second thermosensitive recording layers, has a heat sensitivity lower than heat sensitivities of the first and second thermosensitive recording layers, said method comprising the steps of:

exposing said thermosensitive color recording medium to electromagnetic rays of a first predetermined wavelength for fixing the first thermosensitive recording layer, an intensity of said electromagnetic rays being controlled according to color densities of respective pixels to be recorded in the first thermosensitive recording layer;

applying heat energy to said thermosensitive color recording medium, a first amount of said heat energy being controlled according to color densities of respective pixels to be recorded in the second hermosensitive recording layer, so as to perform thermal recording in the second thermosensitive recording layer and to simultaneously perform heat development in the first thermosensitive recording layer;

exposing said thermosensitive color recording medium to electromagnetic rays of a second predetermined wavelength for fixing the second thermosensitive recording layer; and applying heat energy to said thermosensitive color recording medium by a second amount of said heat energy being controlled according to color densities of respective pixels to be recorded in the third thermosensitive recording layer, so as to perform thermal recording i the third thermosensitive recording layer.

6. A direct color thermal printing method for recording a full-color image on a thermosensitive color recording medium having at least first, second and third thermosensitive recording layers laminated on a supporting material arranged in an order where the first thermosensitive recording layer is adjacent to a top of the thermosensitive color recording medium, the second thermosensitive recording layer is arranged below the first thermosensitive recording layer and the third thermosensitive recording layer is arranged below the second thermosensitive recording layer, each of the first, second and third thermosensitive recording layers independently having a capacity to develop a different color, at least the first and second thermosensitive recording layers having a capacity of being optically fixed by electromagnetic rays of individually specific wavelenght ranges, and the third thermosensitive recording layer, which is arranged below the first and second thermosensitive recording layers, has a heat sensitivity, said method comprising the steps of:

optical recording in the first and second thermosensitive recording layers using electromagnetic rays of different first and second predetermined wavelength ranges respectively for the first and second thermosensitive recording layers, an intensity of said electromagnetic rays being controlled according to color densities of pixels to be recorded; and thermal recording on the third thermosensitive recording layer using an amount of heat energy which is controlled according to color densities of pixels to be recorded, said heat energy being used for heat developments in the first and second thermosensitive recording layers.

7. A direct color thermal printing method as claimed in claim 6, wherein said first, second and third thermosensitive recording layers comprise thermosensitive recording layers which are developed in yellow, magenta and cyan colors, respectively.

8. A direct color thermal printing method as claimed in claim 7, wherein said electromagnetic rays of said first predetermined wavelength range for the first thermosensitive recording layer, which is developed in yellow, is near ultraviolet rays having a center wavelenght of 420 nm, and said electromagnetic rays of said second predetermined wavelength range for the second thermosensitive recording layer, which is developed in magenta, is ultraviolet rays having a center wavelength of 365 nm.

9. A direct color thermal printing method as claimed in claim 8, wherein said near ultraviolet rays and said ultraviolet rays are radiated each from an ultraviolet lamp through a liquid crystal shutter array having a plurality of micro shutters and a lens array having small lenses arranged corresponding to said micro shutters.

10. A direct color thermal printing method for recording a full-color image on a thermosensitive color recording medium having at least first, second and third thermosensitive recording layers laminated on a supporting material arranged in an order where the first thermosensitive recording layer is adjacent to a top of the thermosensitive recording medium, the second thermosensitive recording layer is arranged below the first thermosenstive recording layer and the third thermosensitive recording layer is arranged below the second thermosensitive recording layer, each of the first, second and third thermosensitive recording layers independently having a capacity to develop a different color, at least the first and second thermosensitive recording layers having a capacity of being optically fixed by electromagnetic rays of individually specific wavelength ranges, and the third themosensitive recording layer, which is arranged below the first and second thermosensitive recording layers, has a heat sensitivity lower than heat sensitivities of the first and second thermosensitive recording layers, said method comprising the steps of:

optical recording in the first and second thermosensitive recording layers using electromagnetic rays of different first and second predetermined wavelength ranges respectively for the first and second thermosensitive recording layers, an intensity of said electromagnetic rays being controlled according to color densities of pixels to be recorded;

heat development in the first and second thermosensitive recording layers by applying a constant amount of heat energy thereto; and thermal recording in the third thermosensitive recording layer using an amount of heat energy which is controlled according to color densities of pixels to be recorded.

11. A direct color thermal printing method as claimed in claim 10, wherein said first, second and third thermosensitive recording layers comprise thermosensitive recording layers which are developed in yellow, magenta and cyan colors, respectively.

12. A direct color thermal printing method as claimed in claim 11, wherein said electromagnetic rays of said first predetermined wavelength range for the first thermosensitive recording layer, which is developed in yellow, is near ultraviolet rays having a center wavelength of 420 nm, and said electromagnetic rays of said second predetermined wavelength range for the second thermosensitive recording layer, which is developed in magenta, is ultraviolet rays having a center wavelength of 365 nm.

13. A direct color thermal printing method as claimed in claim 12, wherein said near ultraviolet rays and said ultraviolet rays are radiated each from an ultraviolet lamp through a liquid crystal shutter array having a plurality of micro shutters and a lens array having small lenses arranged corresponding to said micro shutters.

14. A direct color thermal printing method as claimed in claim 13, wherein said constant amount of heat energy is slightly less than a necessary amount for developing heat in the first thermosensitive recording layer.

15. A direct color thermal printing method as claimed in claim 14, where said constant amount of heat energy is radiated from a heat drum disposed between said ultraviolet lamp for optical recording in the second thermosensitive recording layer and a thermal head for thermal recording in the third thermosensitive recording layer.

16. A direct color thermal printing method as claimed in claim 14, wherein every heat element of a thermal head for recording the third thermosensitive recording layer radiates heat energy equal to or higher than said constant amount.

17. A direct color thermal printing apparatus, for recording a full-color image, comprising:

a thermosensitive color recording medium for recording the full-color image thereon including at least first, second and third thermosensitive recording layers laminated on a supporting material arranged an order where the first thermosensitive recording layer is adjacent to a top of the thermosensitive color recording medium, the second thermosensitive recording layer is arranged below the first thermosensitive recording layer and the third thermosensitive recording layer is arranged below the second thermosensitive recording layer, each of said first, second and third thermosensitive recording layers independently having a capacity to develop a different color, at least said first and second thermosensitive recording layers being optically fixed when exposed to electromagnetic rays of individually specific wavelength ranges, and said third thermosensitive recording layer, which is arranged below the first and second thermosensitive recording layers, has a heat sensitivity lower than heat sensitivities of the first and second thermosensitive recording layers;

first optical recording means for optically recording in said first thermosensitive recording layer using electromagnetic rays of a first predetermined wavelength range for said first thermosensitive recording layer by controlling an intensity of said electromagnetic rays according to color densities of pixels to be recorded in said first thermosensitive recording layer;

first thermal recording means for thermally recording in said second thermosensitive recording layer using heat energy by controlling a first amount of said heat energy according to color densities of pixels to be recorded, said heat energy being used for heat development in said first thermosensitive recording layer;

optical fixing means for optically fixing said second thermosensitive recording layer for exposing said thermosensitive color recording medium to electromagnetic rays of a second predetermined wavelength range, for said second thermosensitive recording layer; and second thermal recording means for thermally recording in said third thermosensitive recording layer using a second amount of heat energy which is controlled according to color densities of pixels to be recorded in said third thermosensitive recording layer.

18. A direct color thermal printing apparatus as claimed in claim 17, wherein said first, second and third thermosensitive recording layers comprise thermosensitive recording layers which are developed in yellow, magenta and cyan colors, respectively.

19. A direct color thermal printing apparatus as claimed in claim 18, wherein said electromagnetic rays of said first predetermined wavelength range for said first thermosensitive recording layer, which is developed in yellow, is near ultraviolet rays having a center wavelength of 420 nm, and said electromagnetic rays of said second predetermined wavelength range for said second thermosensitive recording layer, which is developed in magenta, is ultraviolet rays having a center wavelength of 365 nm.

20. A direct color thermal printing apparatus as claimed in claim 19, further comprising an ultraviolet lamp for radiating said near ultraviolet rays through a liquid crystal shutter array having a plurality of micro shutters and a lens array having small lenses arranged corresponding to said micro shutters.

* * * * *